US010646387B2

(12) United States Patent
Sasai et al.

(10) Patent No.: US 10,646,387 B2
(45) Date of Patent: May 12, 2020

(54) ELECTRICALLY POWERED WHEELCHAIR

(71) Applicant: Panasonic Corporation, Osaka (JP)

(72) Inventors: Hiroyuki Sasai, Osaka (JP); Takeshi Ando, Kyoto (JP)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 16/306,928

(22) PCT Filed: Jun. 9, 2017

(86) PCT No.: PCT/JP2017/021406

§ 371 (c)(1),
(2) Date: Dec. 4, 2018

(87) PCT Pub. No.: WO2017/221736

PCT Pub. Date: Dec. 28, 2017

(65) Prior Publication Data

US 2019/0142660 A1 May 16, 2019

(30) Foreign Application Priority Data

Jun. 24, 2016 (JP) ..... 2016-125723

(51) Int. Cl.

| | |
|---|---|
| ***A61G 5/12*** | (2006.01) |
| ***A61G 5/04*** | (2013.01) |
| ***A61G 5/10*** | (2006.01) |

(52) U.S. Cl.

CPC ..... *A61G 5/045* (2013.01); *A61G 5/10* (2013.01); *A61G 5/122* (2016.11); *A61G 5/124* (2016.11); *A61G 5/128* (2016.11); *A61G 2203/72* (2013.01)

(58) Field of Classification Search

CPC ..... A61G 5/04; A61G 5/045; A61G 5/128; A61G 5/1091

See application file for complete search history.

(56) References Cited

U.S. PATENT DOCUMENTS 4,192,546 A * 3/1980 Smith ..... A61G 5/10 297/423.17
5,363,934 A * 11/1994 Edmund ..... A61G 5/045 180/6.5

(Continued)

FOREIGN PATENT DOCUMENTS

CN 101190158 A 6/2008
JP 2003-334218 11/2003

(Continued)

OTHER PUBLICATIONS

The Extended European Search Report dated Apr. 10, 2019 issued in related European Patent Application No. 17815205.4.

(Continued)

*Primary Examiner* — Katy M Ebner

(74) *Attorney, Agent, or Firm* — McDermott Will & Emery LLP

(57) ABSTRACT

An electrically powered wheelchair has a main frame, a seat frame, a seat back frame, a footrest frame, a wheel section, and an obstacle detection sensor. The seat frame is disposed above the main frame, and supports a sitting seat which supports buttocks and thighs of a user. The seat back frame is disposed behind the main frame, and supports a backrest which supports a back of the user. The footrest frame is disposed in front of the main frame, and supports a footrest which supports feet of the user. The wheel section movably supports the main frame. The obstacle detection sensor is installed in front of the seat frame, and detects an obstacle.

12 Claims, 7 Drawing Sheets

(56) References Cited

U.S. PATENT DOCUMENTS

| | | | | |
|---|---|---|---|---|
| 5,713,591 | A * | 2/1998 | Zarkhin | A61G 5/12 248/118.3 |
| 6,842,692 | B2 * | 1/2005 | Fehr | G01C 21/20 701/23 |
| 8,280,561 | B2 * | 10/2012 | Griggs | G05G 9/047 180/19.3 |
| 8,676,420 | B2 * | 3/2014 | Kume | B60L 15/10 701/22 |
| 8,706,332 | B2 * | 4/2014 | Kume | B62B 3/001 180/19.3 |
| 8,882,129 | B2 * | 11/2014 | Nault | A61G 5/12 280/304.1 |
| 8,938,328 | B2 * | 1/2015 | Kume | B60L 58/12 701/22 |
| 9,044,369 | B2 * | 6/2015 | Goldish | A61G 5/14 |
| 9,229,450 | B2 | 1/2016 | Oshima et al. | |
| 9,944,208 | B2 * | 4/2018 | Cheng | B60N 3/063 |
| 2010/0095459 | A1 * | 4/2010 | Lambert | A61G 5/1043 5/653 |
| 2011/0130940 | A1 * | 6/2011 | Smithers | G05D 1/0055 701/99 |
| 2015/0164717 | A1 * | 6/2015 | Lee | A61G 5/04 701/22 |
| 2015/0348416 | A1 | 12/2015 | Fujita et al. | |

FOREIGN PATENT DOCUMENTS

| | | | |
|---|---|---|---|
| JP | 2003334218 | A * | 11/2003 |
| JP | 2010-221784 | A | 10/2010 |
| JP | 2011-177205 | | 9/2011 |
| JP | 2016-013214 | A | 1/2016 |
| WO | 2012/164691 | | 12/2012 |
| WO | 2013/021546 | | 2/2013 |
| WO | 2014/156222 | | 10/2014 |

OTHER PUBLICATIONS

International Search Report of PCT application No. PCT/JP2017/021406 dated Sep. 12, 2017.

English Translation of Chinese Search Report dated May 30, 2019 for the related Chinese Patent Application No. 201780038207.X.

* cited by examiner

ELECTRICALLY POWERED WHEELCHAIR

CROSS-REFERENCE TO RELATED APPLICATIONS

This application is a U.S. national stage application of the PCT International Application No. PCT/JP2017/021406 filed on Jun. 9, 2017, which claims the benefit of foreign priority of Japanese patent application 2016-125723 filed on Jun. 24, 2016, the contents all of which are incorporated herein by reference.

TECHNICAL FIELD

The present disclosure relates to an electrically powered wheelchair with an obstacle detection function.

BACKGROUND ART

An electrically powered wheelchair that has a function of not only moving by operation of a person, but also detecting an obstacle by an obstacle detection sensor and stopping traveling of the electrically powered wheelchair has been known. In particular, a traveling control method for an electrically powered wheelchair in which sophisticated operation is possible is disclosed (for example, see PTL 1).

In the traveling control method, information on presence or absence of an obstacle from the obstacle detection sensor is input to travel permission decision means. In a case where an obstacle is detected, an instruction to activate an alarm is given to alarm activation means and an operation stop instruction is given to motor drive means to temporally stop the electrically powered wheelchair to avoid collision against the obstacle. Then, in the case of waiting for a next operation instruction and receiving a traveling instruction including the direction in which an obstacle is detected from the operation means again, a travel permission (instruction) is given to the motor drive means again and permits the traveling while the alarm activation instruction is sent to the alarm activation means.

Moreover, the configuration of the electrically powered wheelchair for realizing the above operation is shown. In the configuration according to the related art, a configuration in which the obstacle detection sensor is installed on the main body of the electrically powered wheelchair and is disposed at the foremost portion of the sitting surface.

According to the configuration, the electrically powered wheelchair can detect an obstacle in front of the electrically powered wheelchair, and avoid a collision by temporally stopping. In a case where the operation instruction including the direction in which an obstacle is detected is performed again, the electrically powered wheelchair can travel to a vicinity of the obstacle without canceling the obstacle detection means or undergoing special operation procedures by alerting a rider and permitting the operation.

CITATION LIST

Patent Literature

PTL 1: Japanese Patent Unexamined Publication No. 2011-177205

SUMMARY OF THE INVENTION

An electrically powered wheelchair has a main frame, a seat frame, a seat back frame, a footrest frame, a wheel section, and an obstacle detection sensor.

The seat frame is disposed above the main frame, and supports a sitting seat which supports buttocks and thighs of a user.

The seat back frame is disposed behind the main frame, and supports a backrest which supports a back of the user.

The footrest frame is disposed in front of the main frame, and supports a footrest which supports feet of the user.

The wheel section movably supports the main frame.

The obstacle detection sensor is installed in front of the seat frame, and detects an obstacle.

DESCRIPTION OF EMBODIMENTS

Figure 1:
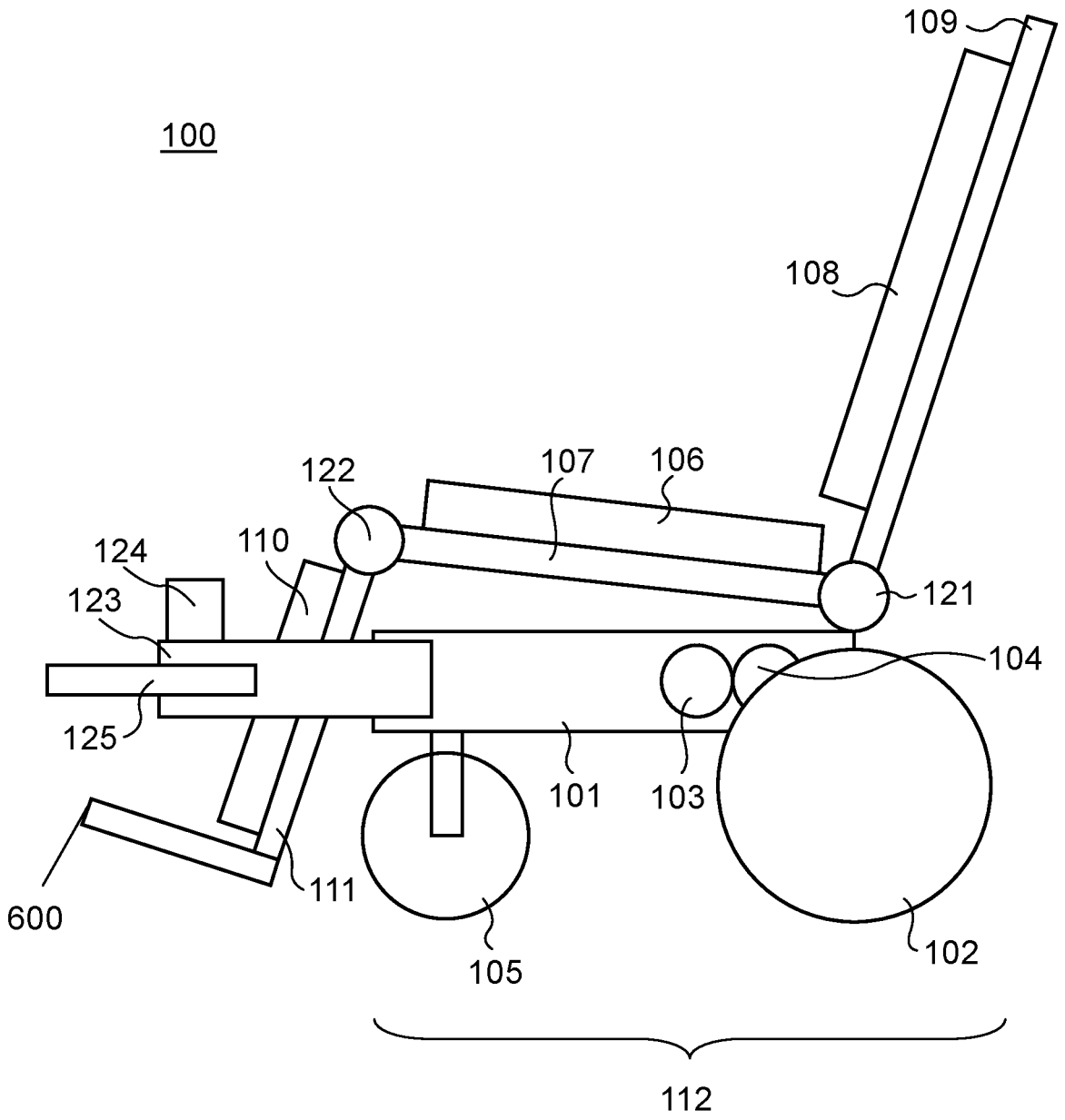
FIG. 1 is a schematic side view of an electrically powered wheelchair according to Embodiment 1.

Prior to the description of the present embodiments, the problem of the electrically powered wheelchair in the related art will be briefly described. In the configuration disclosed in PTL 1, an obstacle detection sensor is disposed at a foremost portion of a sitting surface of the main body of the electrically powered wheelchair. Therefore, in a case where a user is sitting and operating the electrically powered wheelchair, there is a possibility that both feet of the user may be falsely detected as an obstacle when the user has a large body. For example, in a case where the electrically powered wheelchair is used in common at a public place, since different users ride on the same electrically powered wheelchair, there is a very high chance that the above-described problems occur. Moreover, there is a possibility that clothes cover the obstacle detection sensor and are falsely detected as an obstacle.

In the configuration of the related art, it is not possible to detect an obstacle located on a side of or behind the electrically powered wheelchair with the obstacle detection sensor that detects the front side. Therefore, it is necessary to additionally install an obstacle detection sensor for side or rear side detection. As a result, there is a problem that the cost of the entire electrically powered wheelchair increases.

Hereinafter, embodiments of the present disclosure will be described with reference to the drawings. The same reference numerals are attached to the same constituent elements, and the description may be omitted in some cases. Further, in order to make the drawings easier to understand, they are schematically shown mainly by their constituent elements.

Embodiment 1

Figure 2:
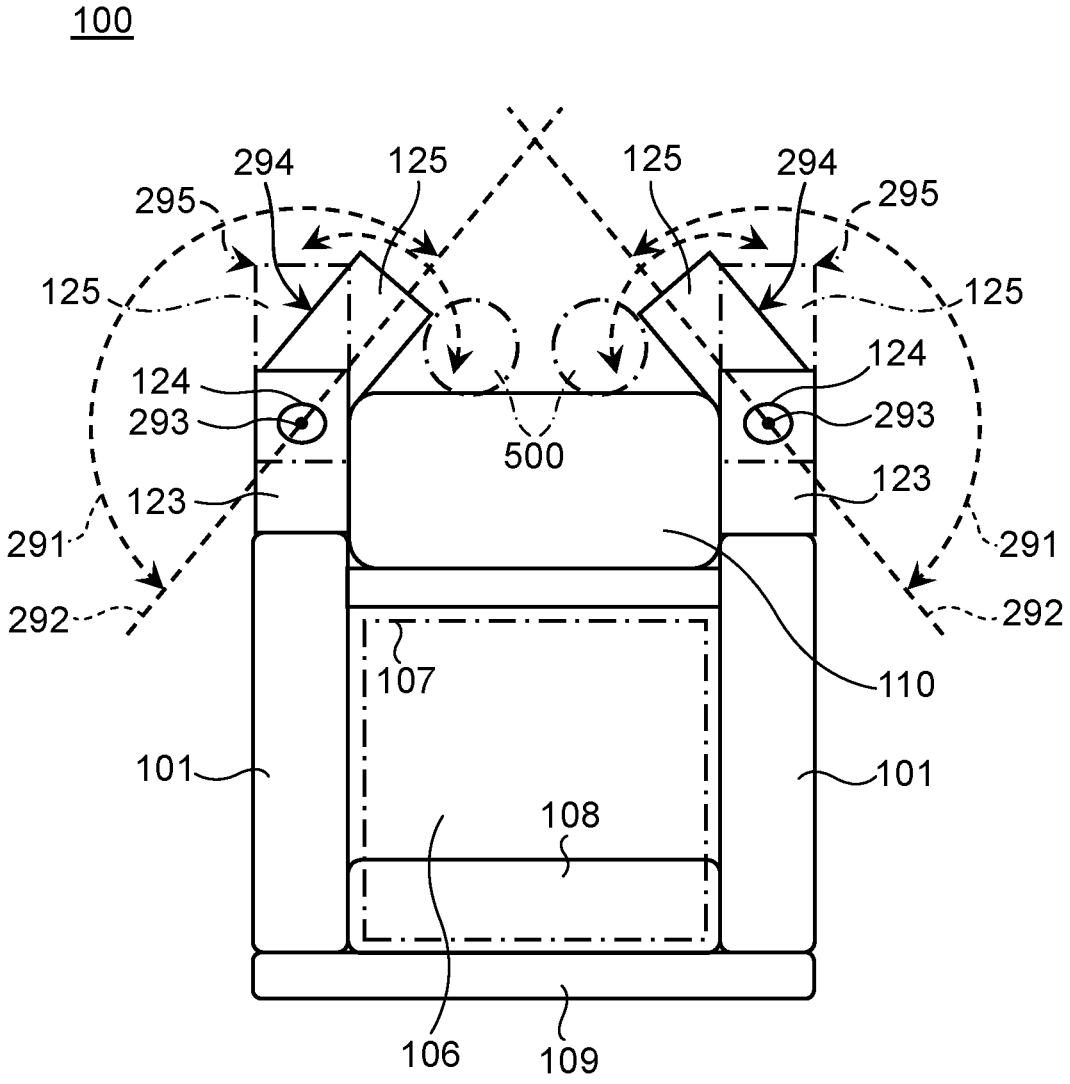
FIG. 2 is a schematic top view showing an obstacle detection range of the electrically powered wheelchair according to Embodiment 1.

FIG. 1 is a schematic side view of electrically powered wheelchair 100 according to Embodiment 1. FIG. 2 is a schematic top view showing an obstacle detection range of electrically powered wheelchair 100 according to Embodiment 1. In FIG. 2, footrest frame 111 is omitted in order to illustrate the detection range easily.

As shown in FIG. 1, electrically powered wheelchair 100 of Embodiment 1 at least has seat frame 107, seat back frame 109, footrest frame 111, wheel section 112, and obstacle detection sensor 124.

Wheel section 112 is configured of pair of right and left drive wheels 102 rotatably attached to main frame 101 and pair of right and left auxiliary wheels 105 provided as steered wheels. Main frame 101 is supported by drive wheels 102 and auxiliary wheels 105.

Seat frame 107 is disposed above main frame 101, and supports sitting seat 106 that supports buttocks and thighs of the user.

Seat back frame 109 is disposed so as to be erected diagonally backward and upward of main frame 101. Seat back frame 109 supports backrest 108 that supports back of the user.

Footrest frame 111 is inclined diagonally downward at the front of main frame 101 and formed in an L-shape. Footrest frame 111 supports footrest 110 that supports feet of the user.

Electrically powered wheelchair 100 may have actuator 121 and actuator 122 in order to adjust respective angles of seat frame 107, seat back frame 109, and footrest frame 111.

When the user rides, sitting seat 106 supports the buttocks and thighs of the user, backrest 108 supports the back of the user, and footrest 110 supports the feet of the user, so that the user can use electrically powered wheelchair 100 in a sitting state.

Obstacle detection sensor 124 detects an obstacle in front of electrically powered wheelchair 100 when the electrically powered wheelchair is moving so that traveling of electrically powered wheelchair 100 is not hindered. One obstacle detection sensor 124 may be installed at the back side of footrest 110, but in FIG. 2, two obstacle detection sensors 124 are installed as an example. In details, obstacle detection sensor 124 is disposed on each side of electrically powered wheelchair 100, at a position in front of seat frame 107 and a side of seat frame 107 behind front end 600 of footrest frame 111. Obstacle detection sensor 124 detects an obstacle within sensing range 291 on the front side of electrically powered wheelchair 100. Sensing range 291 of obstacle detection sensor 124 that detects an obstacle is a semicircular planar shape region inclined with respect to a front-rear direction of electrically powered wheelchair 100 in FIG. 2.

Obstacle detection sensor 124 is installed in front of seat frame 107 and on a side of seat frame 107 behind front end 600 of footrest frame 111 that supports feet 500 of the user. According to the configuration, electrically powered wheelchair 100 can avoid detection of unwanted obstacles such as feet 500 of the user which should not to be detected.

Electrically powered wheelchair 100 may have pair of electrically powered motors 103 to drive pair of drive wheels 102, a battery (not shown) to drive pair of electrically powered motors 103, and controller 104 in main frame 101. Controller 104 independently drives and controls each pair of electrically powered motors 103 to control the movement of electrically powered wheelchair 100.

As a specific example of Embodiment 1, obstacle detection sensor 124 is installed on each side of electrically powered wheelchair 100, at a position in front of seat frame 107 and a side of seat frame 107 behind front end 600 of footrest frame 111. Electrically powered wheelchair 100 may have sensor base 123 that projects in a rectangular parallelepiped shape in the front-rear direction, on each side of footrest frame 111 and at a front end of main frame 101. That is, a rear end of sensor base 123 is fixed at the front end of main frame 101, and obstacle detection sensor 124 may be supported on sensor base 123.

By fixing sensor base 123 on which obstacle detection sensor 124 installed at main frame 101, it is possible to dispose obstacle detection sensor 124 at a position that is reliably in front of seat frame 107 by a length of sensor base 123 and a side of seat frame 107 behind front end 600 of footrest frame 111. Therefore, it is possible to further reliably avoid the detection of unwanted obstacles such as the feet of the user.

Figure 3:
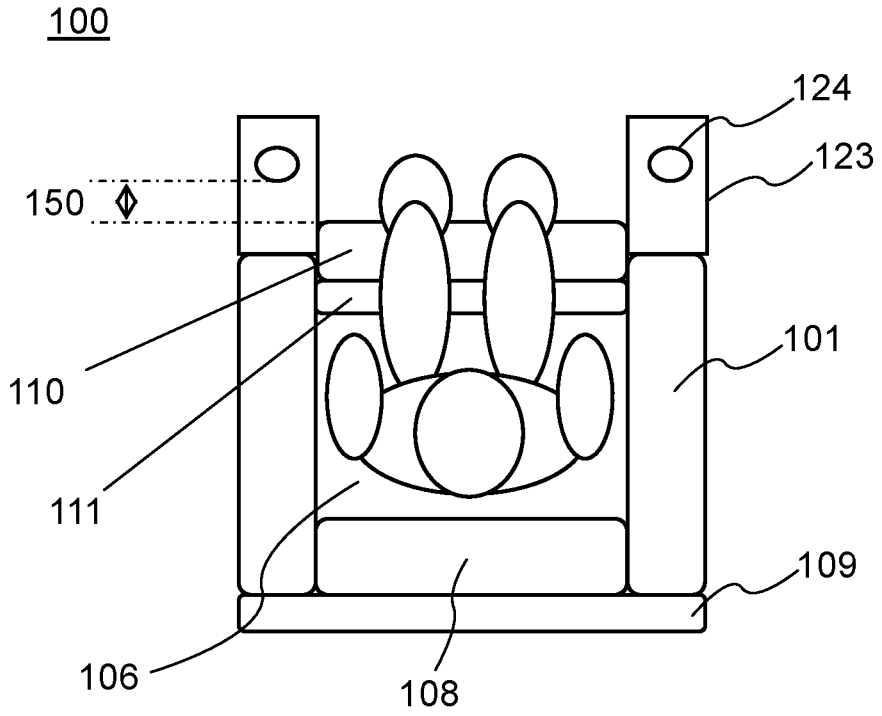
FIG. 3 is a schematic top view of the electrically powered wheelchair and a user according to Embodiment 1.

The position of obstacle detection sensor 124 will be described in more detail. FIG. 3 is a schematic top view of electrically powered wheelchair 100 and a user according to Embodiment 1. In a case where the user is seated, a portion that is projected to the front than footrest 110 is below the knees, and the calves are the thickest. Since the length of the calves are approximately 13 cm in general, it is possible to avoid false detection of the feet of the user by installing obstacle detection sensor 124 approximately 13 cm in front of footrest 110 (see arrow 150 in FIG. 3). In a case of normal sitting, it is considered that the user is often sitting in a relaxed state in which the calves are rather slightly separated from than in close contact to electrically powered wheelchair 100. Therefore, considering that there is a margin of approximately 5 cm as a general situation of sitting comfortably, it is desirable to install obstacle detection sensor 124 approximately 18 cm in front of footrest 110. With this configuration, false detection of the feet of the user can be more reliably avoided.

Figure 4:
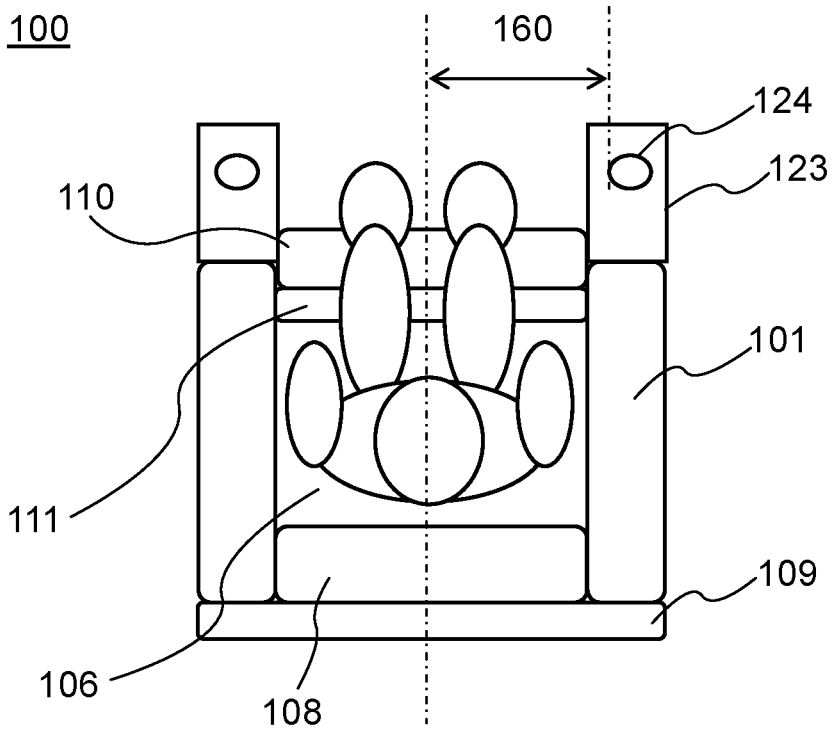
FIG. 4 is a schematic top view of the electrically powered wheelchair and the user according to Embodiment 1.

FIG. 4 is a schematic top view of electrically powered wheelchair 100 and the user according to Embodiment 1. FIG. 4 describes the right-left direction of obstacle detection sensor 124. As described above, considering the length of the calves 13 cm, it is desirable to install obstacle detection sensor 124 13 cm or more outside from a lateral symmetry axis of electrically powered wheelchair 100 (see arrow 160 of FIG. 4). In the case of sitting, since it is considered that the feet are often in a comfortable state in which both feet are approximately one first (approximately 10 cm) apart from the state where both feet are tightly closed, it is desirable to install obstacle detection sensor 124 approximately 18 cm or more outside from the lateral symmetry axis of electrically powered wheelchair 100. Moreover, considering a width of a passage in the case of moving electrically powered wheelchair 100, the width of electrically powered wheelchair 100 may be as narrower as possible to an extent that a person can sit. Accordingly, it is desirable that a position where obstacle detection sensor 124 is installed is located inside the outermost periphery of electrically powered wheelchair 100.

Figure 5:
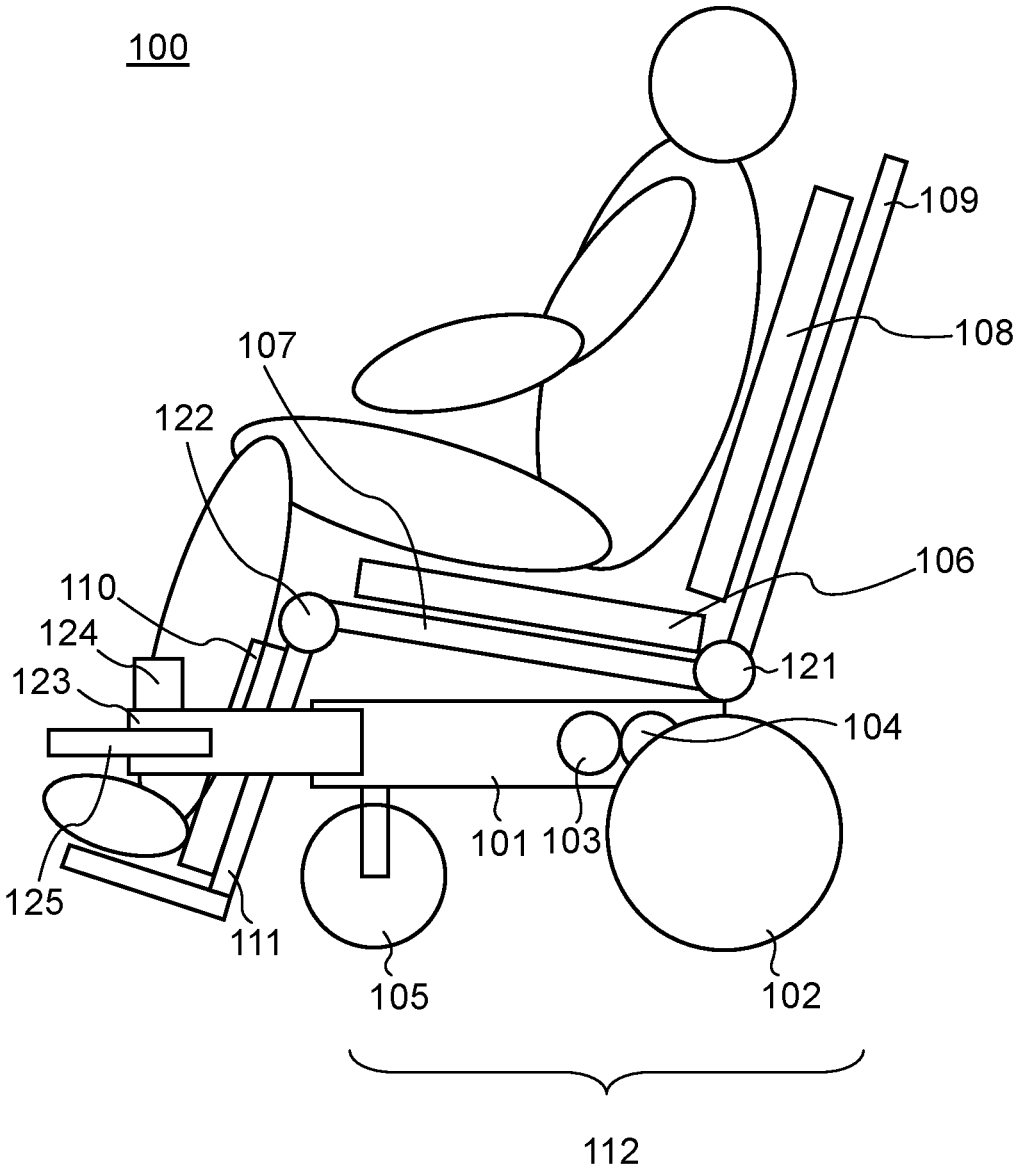
FIG. 5 is a schematic side view of the electrically powered wheelchair and the user according to Embodiment 1.

FIG. 5 is a schematic side view of electrically powered wheelchair 100 and the user according to Embodiment 1. Obstacle detection sensor 124 needs to be installed above a bottom surface of footrest frame 111 for putting feet when sitting. By locating at this position, it is possible to avoid falsely detecting footrest frame 111 itself. Moreover, considering the sitting state, obstacle detection sensor 124 can more reliably avoid the false detection of an instep of the user by installing obstacle detection sensor 124 at a higher position by the height of the instep. General height of the instep is approximately 10 cm. Therefore, it is desirable to install obstacle detection sensor 124 10 cm or higher than footrest frame 111. Depending on a position of front auxiliary wheels 105 as a front wheel and a detection range of obstacle detection sensor 124, in a case where the detection range of obstacle detection sensor 124 extends to the rear, it is desirable to install obstacle detection sensor 124 at a position higher than front auxiliary wheels 105 in order to avoid obstacle detection sensor 124 from falsely detecting front auxiliary wheels 105.

As a modification example of Embodiment 1, electrically powered wheelchair 100 may further have flat plate-shaped foot covers 125 that restrict disposal range of feet 500 of the user, one at each position in front of sensor bases 123 on both sides of electrically powered wheelchair 100. In details, as shown in FIG. 2, in foot cover 125, the rear end of foot cover 125 is rotationally supported by the front end of sensor base 123 within an angle range along a lateral direction, and rotatable within the angle range. The angle range is a rotation range between retract position 295 where there is no problem for the user to get on or get off electrically powered wheelchair 100 and regulation position 294 that is regulated by foot cover 125 so that foot 500 of the user does not fall within sensing range 291 of obstacle detection sensor 124. Here, retract position 295 means, for example, a position of a dashed line along the front-rear direction of electrically powered wheelchair 100 in FIG. 2. Regulation position 294 means, for example, a solid line position in FIG. 2. As described above, when obstacle detection sensor 124 performs detection, it is possible to regulate feet 500 of the user with foot cover 125 by positioning foot cover 125 at regulation position 294. Here, when obstacle detection sensor 124 performs detection is, for example, when the user rides on electrically powered wheelchair 100 and drives electrically powered wheelchair 100. Accordingly, it is possible to regulate feet 500 of the user so as not to fall within sensing range 291 of obstacle detection sensor 124 by foot cover 125. As a result, it is possible to eliminate the false detection of an object which should not be detected as an obstacle, such as feet 500 of the user.

In order to describe operation of foot cover 125, a top view of electrically powered wheelchair 100 is described in FIG. 2. Obstacle detection sensors 124 are installed on sensor bases 123 fixed on the front end side of main frame 101, and obstacle detection ranges (sensing ranges) 291 of obstacle detection sensors 124 disposed one on each side of electrically powered wheelchair 100 are set so as to overlap in front of electrically powered wheelchair 100.

Foot cover 125 may be supported by sensor base 123 such that foot cover 125 rotates between regulation position 294 and retract position 295 around central axis 293 that is substantially coincident with a position where obstacle detection sensor 124 is fixed to sensor base 123.

According to a modification example of Embodiment 1, obstacle detection sensor 124 can be disposed in front of footrest 110 by the length of sensor base 123. As indicated by a dashed line in FIG. 2, since seat frame 107 is disposed behind footrest 110, obstacle detection sensor 124 is disposed in front of seat frame 107. In a case where the user rides on and uses electrically powered wheelchair 100, the buttocks and thighs of the user is supported by seat frame 107, and feet 500 of the user is supported by footrest 110 and footrest frame 111. In this case, since obstacle detection sensor 124 is positioned in front of seat frame 107 and a side of seat frame 107 behind front end 600 of footrest frame 111, the possibility of obstacle detection sensor 124 falsely detecting feet 500 of the user as an obstacle becomes very low.

Furthermore, after the user rides on electrically powered wheelchair 100, foot cover 125 can be rotated from retract position 295 to regulation position 294 on central axis 293 (rotation axis) having the same substantially coincident central axis at a position where obstacle detection sensor 124 is fixed to sensor base 123. Accordingly, it is possible to make boundary 292 of sensing range 291 of obstacle detection sensor 124 to substantially match with the position of foot cover 125 (see regulation position 294 of foot cover 125 of solid line in FIG. 2). As a result, it is possible to effectively restrict feet 500 of the user not to protrude into a region of sensing range 291.

In this way, obstacle detection sensor 124 can be installed at a position in front of seat frame 107 and a side of seat frame 107 behind front end 600 of side footrest frame 111, and can efficiently restrict feet 500 of the user not to protrude into a region of sensing range 291, with provided foot cover 125. Accordingly, it is possible to eliminate the false detection of an object which should not be detected as an obstacle, such as feet 500 of the user.

Embodiment 2

Figure 6:
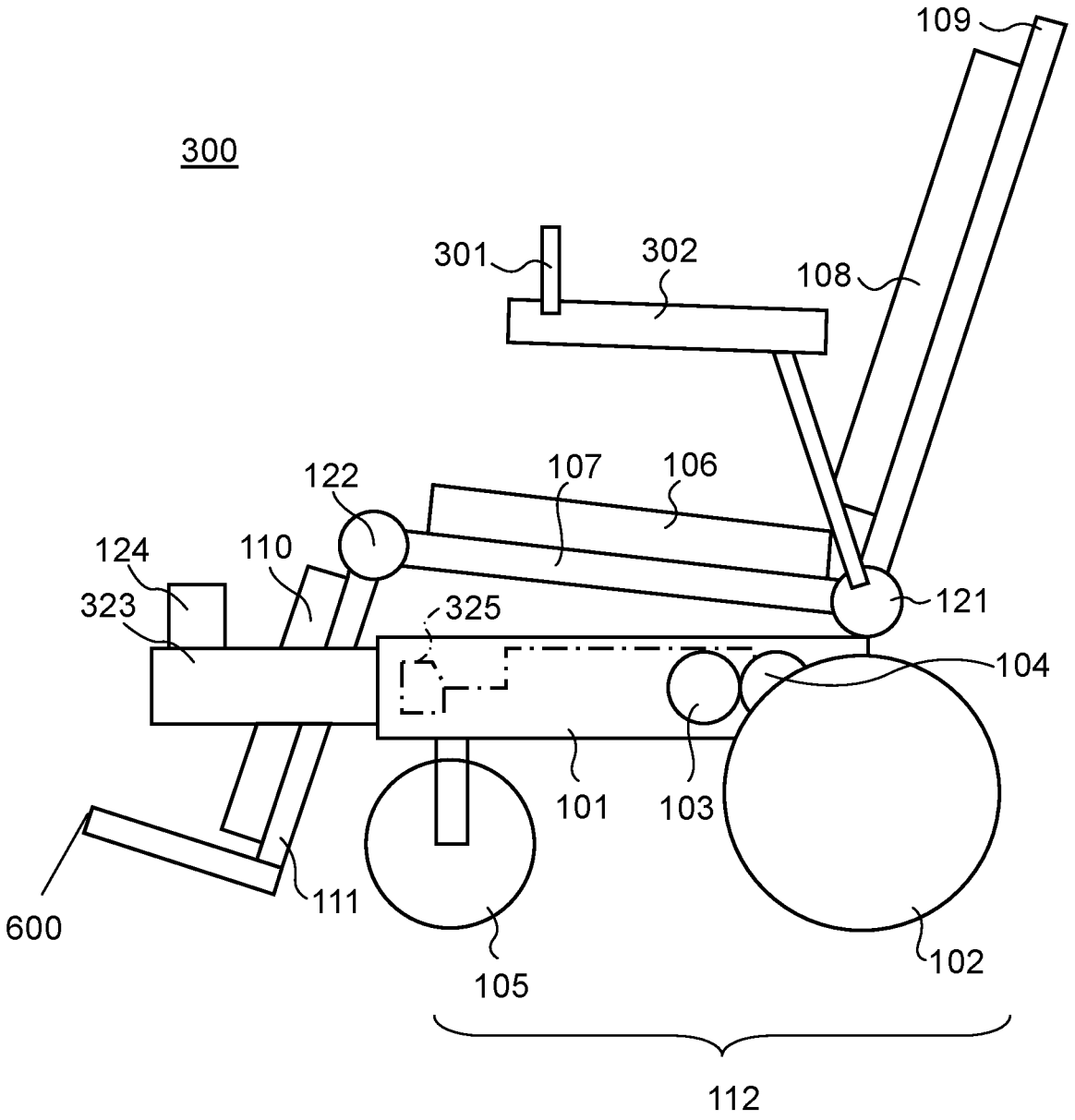
FIG. 6 is a schematic side view of an electrically powered wheelchair according to Embodiment 2.
Figure 7:
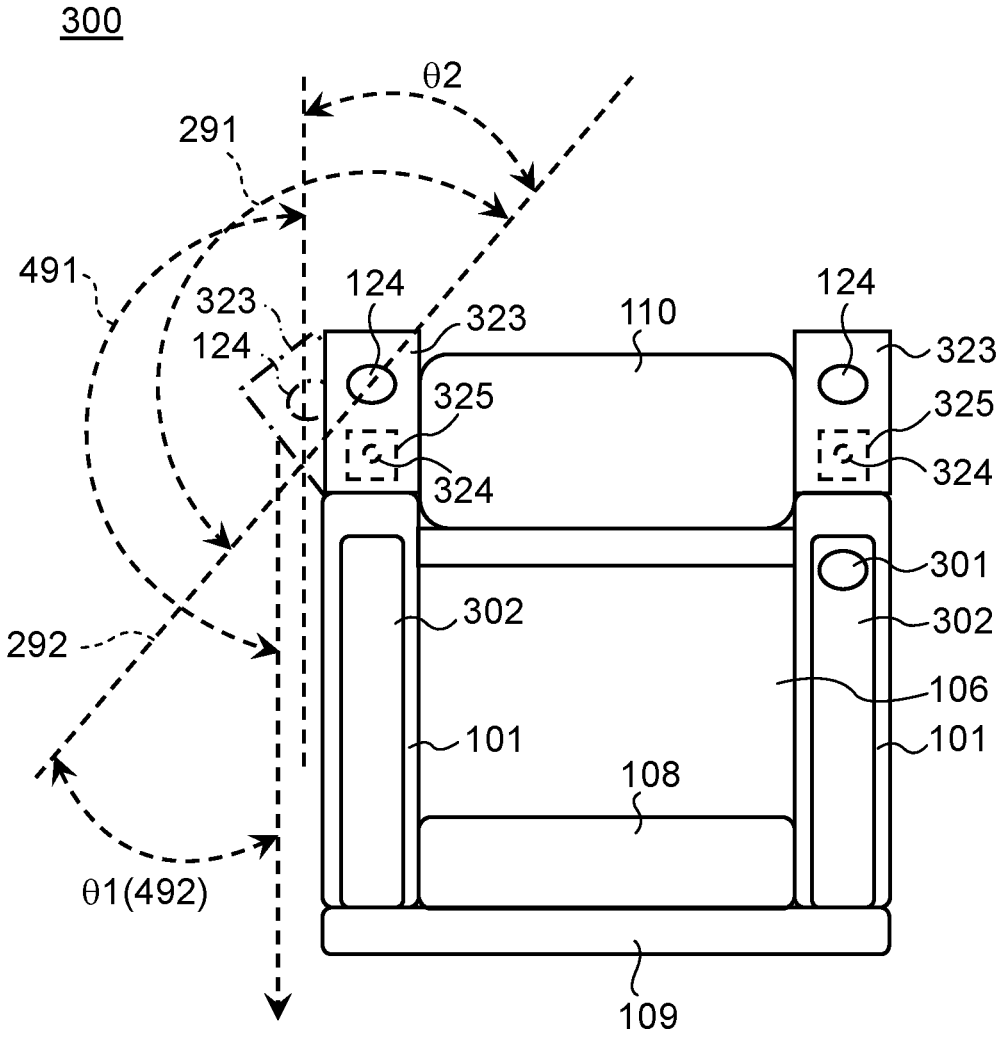
FIG. 7 is a schematic top view showing an obstacle detection range of the electrically powered wheelchair according to Embodiment 2.

FIG. 6 is a schematic side view of electrically powered wheelchair 300 according to Embodiment 2. FIG. 7 is a schematic top view showing an obstacle detection range of electrically powered wheelchair 300 according to Embodiment 2.

The basic configuration of electrically powered wheelchair 300 is the same as the configuration of electrically powered wheelchair 100 in FIG. 1. Electrically powered wheelchair 300 further includes operation lever 301 and arm rest 302 in addition to the configuration of electrically powered wheelchair 100 of FIG. 1. In Embodiment 2, the description of the same configuration and operation as in FIG. 1 will be omitted.

Operation lever 301 is connected with controller 104. Pair of electrically powered motors 103 are controlled so as to move electrically powered wheelchair 300 in a swinging direction (traveling direction) by swinging operation lever 301 back and forth and right and left.

That is, the user can ride on electrically powered wheelchair 300 and move electrically powered wheelchair 300 in the same direction as the direction in which swinging operation is performed by swinging operation lever 301 in the same direction as the direction in which electrically powered wheelchair 300 is to be moved. The back and forth and right and left direction applied to operation lever 301 is transmitted to controller 104. Controller 104 controls electrically powered motor 103 to move electrically powered wheelchair 300 in the same direction as the direction applied to operation lever 301. Pair of electrically powered motors 103 rotationally drive pair of drive wheels 102 in forward and reverse directions to move electrically powered wheelchair 300.

Obstacle detection sensors 124 that detect an obstacle are installed on sensor bases 323 that project in the front-rear direction, for example, in a rectangular parallelepiped shape on both sides of footrest frame 111 and the front end of main frame 101. As shown in FIG. 7, the rear end of sensor base 323 is rotatably supported around rotation axis 324 in the right-left direction with respect to the front end of main frame 101. Sensor base 323 is rotationally driven by motor 325 for rotation of sensor base that functions as an example of a rotation drive device so as to rotate based on a direction applied to operation lever 301 in which controller 104 detected. That is, in a case where a right or left movement component is detected as a direction applied to operation lever 301, controller 104 moves sensor base 323 on the same side with the direction of the movement component to an outside of electrically powered wheelchair 300, and enables the detection range of an obstacle to be extended behind electrically powered wheelchair 300.

The operation of electrically powered wheelchair 300 having the same configuration as described above will be described in more details. FIG. 7 shows a top view of electrically powered wheelchair 300. For example, in a case where the user swung operation lever 301 in the left direction in order to move electrically powered wheelchair 300 in the left direction, controller 104 detects a left side component as a component applied to operation lever 301. In a case where controller 104 detected the left side component, motor 325 for rotation of sensor base on the left side is rotationally driven and controlled by controller 104 to rotate sensor base 323 on the left side of electrically powered wheelchair 300 around rotation axis 324 to the left side which is the outside of electrically powered wheelchair 300 by angle θ2. At this time, if the angle formed between boundary 292 of sensing range 291 before the rotation of sensor base 323 and the front-rear direction of electrically powered wheelchair 300 is θ1, sensor base 323 is driven by angle θ2 equivalent to θ1. According to the configuration, sensing range 291 of obstacle detection sensor 124 can be rotationally moved backward by angle θ2 (01) to obtain changed sensing range 491. As a result, in changed sensing range 491, it is possible to detect an obstacle at the back within range 492 of angle θ1. The obstacle at the back within range 492 of angle θ1 is an obstacle that could not be detected since the obstacle was outside the sensing range before changing sensing range 291.

As obstacle detection sensor 124, it is possible to use a laser sensor in general, but a time of flight (TOF) sensor may also be used. In this case, it is possible to lower the cost of electrically powered wheelchair 300 compared to the case where a laser sensor is used. Also, a stereo camera may be used. In this case, since it is possible to obtain color information in addition to information on depth, it is possible to obtain more detailed information on the obstacle, and to realize accurate obstacle avoidance.

Moreover, sensor base 323 and foot cover 125 can be combined. According to the combination, obstacle detection sensor 124 can avoid false detection of feet 500 of the user as an obstacle in addition to the above-described effect of the sensor base 323 at the same time.

According to Embodiment 2, it is possible to move sensor base 323 that supports obstacle detection sensor 124 to the outside of electrically powered wheelchair 300 according to the direction applied to operation lever 301. Accordingly, in a case where electrically powered wheelchair 300 is moved to right and left, it is possible to detect an obstacle on the right and left side and at the back with single obstacle detection sensor 124. As a result, it is possible to avoid the risk of collision against an obstacle without installing additional sensors.

According to the above-described embodiments, it is possible to avoid the unwanted obstacle detection by the position of obstacle detection sensor 124, sensor bases 123 and 323, and foot cover 125. It is also possible to extend detection range of an obstacle compared to the related art by moving sensor base 323 when operating in the right-left direction. As a result, it is possible to provide electrically powered wheelchairs 200 and 300 that can move safely by avoiding obstacles.

By combining any embodiments or modification examples of the above-described various embodiments or modification examples, it is possible to achieve the respective effects possessed by them. Moreover, it is possible to combine the embodiments, to combine the examples, or to combine the embodiments and the examples, and to combine features in different embodiments or examples.

As described above, according to the above-described embodiments, it is possible to eliminate the false detection of an object which should not be detected as an obstacle, such as feet of the user by installing the obstacle detection sensor at a position in front of the seat frame.

INDUSTRIAL APPLICABILITY

The electrically powered wheelchair of the present disclosure can avoid detection of unwanted obstacles such as feet of the user by installing the obstacle detection sensor at a position in front of the seat frame. As a result, it is useful as an electrically powered wheelchair to be used in areas requiring indoor and outdoor movement such as nursing care or welfare fields.

REFERENCE MARKS IN THE DRAWINGS

100 ELECTRICALLY POWERED WHEELCHAIR
101 MAIN FRAME
102 DRIVE WHEEL
103 ELECTRICALLY POWERED MOTOR
104 CONTROLLER
105 AUXILIARY WHEEL
106 SITTING SEAT
107 SEAT FRAME
108 BACKREST
109 SEAT BACK FRAME
110 FOOTREST
111 FOOTREST FRAME
112 WHEEL SECTION
121 ACTUATOR
122 ACTUATOR
123 SENSOR BASE
124 OBSTACLE DETECTION SENSOR
125 FOOT COVER
150 ARROW
160 ARROW
291 SENSING RANGE
292 BOUNDARY (BOUNDARY OF SENSING RANGE)
293 CENTRAL AXIS (ROTATION AXIS)
294 REGULATION POSITION (FOOT COVER POSITION SUBSTANTIALLY CONSISTENT WITH BOUNDARY OF SENSING RANGE)
295 RETRACT POSITION
300 ELECTRICALLY POWERED WHEELCHAIR
301 OPERATION LEVER
302 ARM REST
323 SENSOR BASE
324 ROTATION AXIS
325 MOTOR FOR ROTATION OF SENSOR BASE
491 CHANGED SENSING RANGE
492 RANGE OF ANGLE θ1
500 FEET OF USER
600 FRONT END

The invention claimed is:

1. An electrically powered wheelchair comprising:

a main frame;

a seat frame that is disposed above the main frame, and supports a sitting seat which supports buttocks and thighs of a user;

a seat back frame that is disposed behind the main frame, and supports a backrest which supports a back of the user;

a footrest frame that is disposed in front of the main frame, and supports a footrest which supports feet of the user;

a wheel section that movably supports the main frame;

an obstacle detection sensor that is installed in front of the seat frame, and detects an obstacle within a sensing range on a front side of the electrically powered wheelchair;

a foot cover that is attached to the main frame and regulates at least one of the feet of the user not to fall within a detection range of the obstacle detection sensor when the obstacle detection sensor performs detection by restricting a disposal range of the at least one of the feet of the user; and a sensor base that projects forward from the main frame, wherein:

the obstacle detection sensor is installed on the sensor base, and the foot cover is installed on the sensor base.

2. The electrically powered wheelchair of claim 1, wherein the obstacle detection sensor is installed in front of the footrest.

3. The electrically powered wheelchair of claim 1, wherein the obstacle detection sensor is installed at a side of the seat frame behind a front end of the footrest frame.

4. The electrically powered wheelchair of claim 3, wherein the footrest frame is formed in an L-shape.

5. The electrically powered wheelchair of claim 1, further comprising:

an operation lever that is movable in back and forth and right and left so that the user can drive the electrically powered wheelchair in a traveling direction;

a controller that detects a swinging direction in back and forth and right and left applied to the operation lever, and controls the operation of the wheel section; and a rotation drive device that moves the sensor base on the same side as a direction of a movement component to an outside of the electrically powered wheelchair in a case where the movement component to right or left is detected as a direction applied to the operation lever.

6. The electrically powered wheelchair of claim 1, wherein the foot cover is configured to be rotated on a central axis having the same substantially coincident central axis as a position where the obstacle detection sensor is fixed to the sensor base.

7. The electrically powered wheelchair of claim 6, wherein the foot cover is configured to be rotated from a retract position to a position substantially coincident with a boundary of the sensing range after the user rides on the electrically powered wheelchair, the retract position being a position where the cover member does not interfere the user from getting on or getting off the electrically powered wheelchair.

8. The electrically powered wheelchair of claim 1, wherein the foot cover disposed such that a position of the foot cover matches a boundary of the sensing range.

9. The electrically powered wheelchair of claim 1, wherein at least a part of the foot cover is disposed at a position of a side of the footrest, the position being beyond a boundary of the sensing range in a top view.

10. The electrically powered wheelchair of claim 1, wherein:

a rear end of the foot cover is rotationally supported by a front end of a sensor base within an angle range along a lateral direction, and rotatable within the angle range, and the angle range is a rotation range between a retract position where the cover member does not interfere the user from getting on or getting off the electrically powered wheelchair and a regulation position that is regulated by the foot cover so that the at least one of the feet of the user does not fall within the sensing range of the obstacle detection sensor.

11. An electrically powered wheelchair comprising:

a main frame;

a seat frame that is disposed above the main frame, and supports a sitting seat which supports buttocks and thighs of a user;

a seat back frame that is disposed behind the main frame, and supports a backrest which supports a back of the user;

a footrest frame that is disposed in front of the main frame, and supports a footrest which supports feet of the user;

a wheel section that movably supports the main frame;

an obstacle detection sensor that is installed in front of the seat frame, and detects an obstacle;

a foot cover that regulates at least one of the feet of the user not to fall within a detection range of the obstacle detection sensor when the obstacle detection sensor performs detection; and a sensor base that projects forward from the main frame, wherein:

the obstacle detection sensor is installed on the sensor base, and the foot cover is installed on the sensor base.

12. An electrically powered wheelchair comprising:

a main frame;

a seat frame that is disposed above the main frame, and supports a sitting seat which supports buttocks and thighs of a user;

a seat back frame that is disposed behind the main frame, and supports a backrest which supports a back of the user;

a footrest frame that is disposed in front of the main frame, and supports a footrest which supports feet of the user;

a wheel section that movably supports the main frame;

an obstacle detection sensor that is installed in front of the seat frame, and detects an obstacle;

a foot cover that regulates at least one of the feet of the user not to fall within a detection range of the obstacle detection sensor when the obstacle detection sensor performs detection; an operation lever that is movable in back and forth and right and left so that the user can drive the electrically powered wheelchair in a traveling direction;

a sensor base that projects forward from the main frame;

a controller that detects a swinging direction in back and forth and right and left applied to the operation lever, and controls the operation of the wheel section; and a rotation drive device that moves the sensor base on the same side as a direction of a movement component to an outside of the electrically powered wheelchair in a case where the movement component to right or left is detected as a direction applied to the operation lever;

wherein the obstacle detection sensor is installed on the sensor base;

component to right or left is detected as a direction applied to the operation lever.

* * * * *